US011008842B2

(12) United States Patent
Aguilera et al.

(10) Patent No.: US 11,008,842 B2
(45) Date of Patent: May 18, 2021

(54) METHODS FOR HYDRAULIC FRACTURING

(71) Applicants: CNOOC PETROLEUM NORTH AMERICA ULC, Calgary (CA); Roberto Aguilera, Calgary (CA); Daniel Orozco, Calgary (CA)

(72) Inventors: Roberto Aguilera, Calgary (CA); Daniel Orozco, Calgary (CA); Karthikeyan Selvan, Calgary (CA); Faisal Qureshi, Calgary (CA)

(73) Assignee: CNOOC PETROLEUM NORTH AMERICA ULC, Calgary (CA)

( * ) Notice: Subject to any disclaimer, the term of this patent is extended or adjusted under 35 U.S.C. 154(b) by 460 days.

(21) Appl. No.: 15/768,678

(22) PCT Filed: Oct. 14, 2016

(86) PCT No.: PCT/CA2016/000258

§ 371 (c)(1),
(2) Date: Apr. 16, 2018

(87) PCT Pub. No.: WO2017/063073

PCT Pub. Date: Apr. 20, 2017

(65) Prior Publication Data

US 2018/0313198 A1 Nov. 1, 2018

Related U.S. Application Data

(60) Provisional application No. 62/241,445, filed on Oct. 14, 2015.

(51) Int. Cl.
*E21B 43/26* (2006.01)
*E21B 47/07* (2012.01)
(Continued)

(52) U.S. Cl.
CPC ..... *E21B 43/26* (2013.01); *E21B 47/06* (2013.01); *E21B 47/07* (2020.05); *E21B 49/02* (2013.01)

(58) Field of Classification Search
CPC ..... E21B 43/26; E21B 47/06; E21B 47/07; E21B 49/02
See application file for complete search history.

(56) References Cited

U.S. PATENT DOCUMENTS 3,393,741 A * 7/1968 Huitt ..... E21B 43/26 166/308.1
3,664,422 A * 5/1972 Bullen ..... E21B 43/26 166/283

(Continued)

OTHER PUBLICATIONS

The International Bureau of WIPO, "International Preliminary Report on Patentability and Written Opinion" for International Application No. PCT/CA2016/000258, dated Apr. 17, 2018.

*Primary Examiner* — Christopher J Sebesta
(74) *Attorney, Agent, or Firm* — Norton Rose Fulbright Canada LLP

(57) ABSTRACT

A method for capturing hydrocarbons from a formation is provided. After a first hydraulic fracturing of a formation to produce a first conditioned formation, and while hydrocarbons are being produced from the first conditioned formation, a predetermined wellbore characteristic is monitored for. The predetermined wellbore characteristic is based on at least a pressure within the first conditioned formation. After detecting the predetermined wellbore characteristic, a second hydraulic fracturing of the formation is effected to produce a second conditioned formation.

29 Claims, 6 Drawing Sheets

(51) Int. Cl.
*E21B 47/06* (2012.01)
*E21B 49/02* (2006.01)

(56) References Cited

U.S. PATENT DOCUMENTS 5,472,050 A * 12/1995 Rhoten ..... E21B 43/12
166/250.1
7,096,943 B2 * 8/2006 Hill ..... E21B 43/04
166/250.1

* cited by examiner

METHODS FOR HYDRAULIC FRACTURING

PRIORITY

This application claims priority to U.S. Provisional Application Ser. No. 62/241,445 filed Oct. 14, 2015, entitled "Systems and Methods for Hydraulic Fracturing", which is incorporated by reference herein in its entirety.

FIELD

This invention is directed to a method of capturing hydrocarbons from low permeability reservoirs. Specifically, this invention is directed to a method of hydraulically fracturing such reservoirs after production of hydrocarbons has been initiated to increase production of the hydrocarbons.

BACKGROUND

In producing hydrocarbons from within a subterranean formation, a wellbore is drilled, penetrating the subterranean formation. This provides a partial flow path for hydrocarbon, received by the wellbore, to be conducted to the surface. In order to be received by the wellbore at a sufficiently desirable rate, there must exist a sufficiently unimpeded flow path from the hydrocarbon-bearing formation to the wellbore through which the hydrocarbon may be conducted to the wellbore.

In some cases, such as in low and ultra-low permeability formations, it is necessary to create new fractures or extend existing fractures within the subterranean formation in order to establish the flow path for conducting the hydrocarbon to the wellbore. Such fractures are more permeable to the flow of hydrocarbons than the formation. Examples of such low and ultra-low permeability formations include shale dry-gas reservoirs, shale gas-condensate reservoirs, shale oil reservoirs, tight oil reservoirs, and tight gas reservoirs.

To initiate new fractures, and/or extend and interconnect existing fractures, hydraulic fracturing fluid is injected through wellbore into the subterranean formation at sufficient rates and pressures for the purpose of hydrocarbon production stimulation. The fracturing fluid injection rate exceeds the filtration rate into the formation producing increasing hydraulic pressure at the sand face. When the pressure exceeds a formation fracturing pressure, the formation rock cracks and fractures. After this hydraulic fracturing stage, proppant may be flowed downhole within the wellbore and deposited in the fracture to prevent the fracture from closing once the fluid injection is suspended, thereby helping to preserve the integrity of the flow path.

Production from the formation can then be initiated. As hydrocarbons are produced from fractured formations, the pressure of the well decreases. In formations that are compressible, the decrease of pressure tends to increase the forces urging the fractures to close. After continuous production, the proppant may not be sufficient to counteract forces urging the fractures to close. Increasing compression forces may effect a reduction in porosity and permeability as well as the closure of natural micro fractures and slots. The closure of hydraulic fractures leads to reduction in well productivity.

The reduction in productivity can be reversed, at least in part, by re-fracturing the formation. Prior methods for the determination of when re-fracturing should be effected are based on well economics.

There exists a need for improved methods for re-fracturing formations in order to increase the recovery of the hydrocarbons in the formation.

SUMMARY

In one aspect, there is provided a method for capturing hydrocarbons from a formation. After a first hydraulic fracturing of a formation to produce a first conditioned formation, and while hydrocarbons are being produced from the first conditioned formation, a predetermined wellbore characteristic is monitored for. The predetermined wellbore characteristic is based on at least a pressure within the first conditioned formation. After detecting the predetermined wellbore characteristic, a second hydraulic fracturing of the formation is effected to produce a second conditioned formation.

In some embodiments, the formation is a shale formation.

In some embodiments, the hydrocarbons are gaseous hydrocarbons.

In some embodiments, the predetermined wellbore characteristic is established when $$\frac{\partial^2 \frac{P}{Z}}{\partial G_p^2} = 0,$$

wherein:

$$\frac{G_p}{G_t} = 1 - \frac{P/Z'}{P_i/Z_i} \text{ and}$$

$$Z' = Z\left[1 - \omega_a - \omega_d - (\omega_m C' + \omega C'')\Delta P + \left(\frac{\omega_m B_g \rho_b V_L}{35.315\phi_{mt}(1 - S_{wm})}\frac{P}{P_L + P}\right) + \left(\frac{1.057\omega_m C_{(P)} B_g}{\phi_{mt}(1 - S_{wm})}\right)\left(\frac{TOC}{100\rho_r} - \phi_{ads_c} - \phi_{org}\right)\right]^{-1}.$$

In some embodiments, the predetermined wellbore characteristic is established when the difference between:

$$\frac{\partial \frac{P}{Z}}{\partial G_p}, \quad \text{a)}$$

where:

$$\frac{G_p}{G_t} = 1 - \frac{P/Z'}{P_i/Z_i} \text{ and}$$

$$Z' = Z\left[1 - \omega_a - \omega_d - (\omega_m C' + \omega C'')\Delta P + \left(\frac{\omega_m B_g \rho_b V_L}{35.315\phi_{mt}(1 - S_{wm})}\frac{P}{P_L + P}\right) + \left(\frac{1.057\omega_m C_{(P)} B_g}{\phi_{mt}(1 - S_{wm})}\right)\left(\frac{TOC}{100\rho_r} - \phi_{ads_c} - \phi_{org}\right)\right]^{-1};$$

and

-continued $$\frac{\partial \frac{P}{Z}}{\partial G_p}, \quad \text{b)}$$

where:

$$\frac{G_p}{G_t} = 1 - \left(\frac{P/Z}{P_i/Z_i}\right)\{1 - [(1-\omega)C' + \omega C'')\Delta P\}$$

differ by a predetermined threshold.

In some embodiments, the cumulative gas production is monitored, and the predetermined wellbore characteristic is established at:

$$t_{refrac} = \frac{1}{C_{refrac}} \int_0^{G_{p_{refrac}}} \frac{dG_p}{\{[f(G_p)]^2 - P_{wf}^2\}^n}.$$

In some embodiments, the temperature of the formation are monitored.

In some embodiments, hydrocarbons are produced from the second conditioned formation.

In some embodiments, the maximum volumetric rate of production of hydrocarbons from the second conditioned formation is at least 20% of the maximum volumetric rate of production of hydrocarbons from the first conditioned formation.

In some embodiments, the maximum volumetric rate of production of hydrocarbons from the second conditioned formation is at least 100% of the maximum volumetric rate of production of hydrocarbons from the first conditioned formation.

In some embodiments, the second hydraulic fracturing re-opens the fractures effected by the first hydraulic fracturing.

In some embodiments, the second hydraulic fracturing effects new fractures being formed in the second conditioned formation.

In some embodiments, the maximum pressure at which the treatment fluid is injected into the wellbore during the second hydraulic fracturing has a gradient of at least 0.65 psi per foot of depth.

In some embodiments, during the second hydraulic fracturing, the treatment fluid is injected at an injection pressure of at least 0.65 psi per foot of depth into the wellbore during the second hydraulic fracturing for at least 0.1 days per fracturing stage.

In another aspect, there is provided a method for capturing hydrocarbons from a formation. After a first hydraulic fracturing of a formation to produce a first conditioned formation, and after hydrocarbons have been produced from the first conditioned formation, and after a formation pressure of the formation has become disposed below a predetermined pressure, a second hydraulic fracturing of the formation is effected to produce a second conditioned formation.

DETAILED DESCRIPTION

Figure 1:
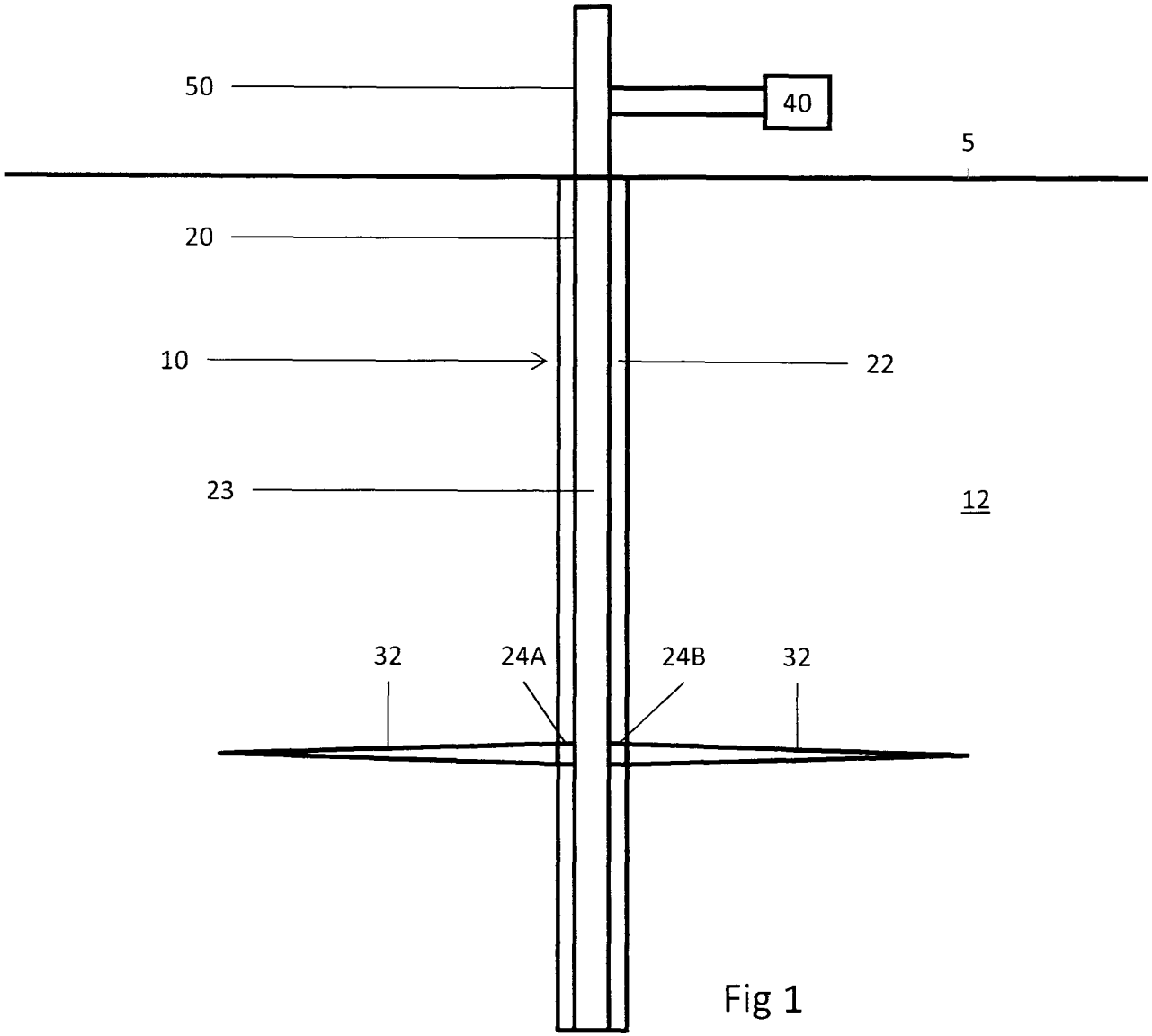
FIG. 1 is a schematic diagram of an exemplary wellbore installation.

FIG. 1 illustrates an exemplary wellbore installation. A wellbore 10 penetrates a surface 5 of, and extends through, a subterranean formation 12. The subterranean formation 12 may be onshore or offshore. The subterranean formation 12 includes at least one zone 14 where fractures are naturally found, or are to be effected by hydraulic fracturing.

The wellbore 10 can be straight, curved, or branched. The wellbore can have various wellbore portions. A wellbore portion is an axial length of a wellbore. A wellbore portion can be characterized as "vertical" or "horizontal" even though the actual axial orientation can vary from true vertical or true horizontal, and even though the axial path can tend to "corkscrew" or otherwise vary. The term "horizontal", when used to describe a wellbore portion, refers to a horizontal or highly deviated wellbore portion as understood in the art, such as, for example, a wellbore portion having a longitudinal axis that is between 70 and 110 degrees from vertical.

The wellbore 10 may be cased, such as with casing 20 that is disposed within the wellbore 10. The casing 20 includes a wellbore fluid passage 23 configured to conduct fluids to and from the at least one zone 14 of the subterranean formation 12, as is explained below. In some embodiments, for example, the casing 20 is cemented to formation 12 with cement 22 disposed within the annular region between the casing 20 and the formation 12.

In some embodiments, for example, the at least one zone 14 of the formation 12 has low permeability or ultra-low permeability, such as a tight sand oil reservoir, a tight sand gas reservoir, an oil-rich shale reservoir, or a gas-rich shale. In some embodiments, the matrix permeability of the formation is less than 0.1 millidarcies. For example, tight sand reservoirs can have permeabilities of as between 0.1 to 0.001 millidarcies; and shale reservoirs can have permeabilities of 0.001 to 0.0001 millidarcies.

A wellhead 50 is coupled to and substantially encloses the wellbore 10 at the surface 2. The wellhead 50 includes conduits and valves to direct and control the flow of fluids to and from the wellbore 10.

Fluid communication is effected between the fluid passage 23 and the formation 12 via ports or openings 24. In some embodiments, for example, one or more of the ports or openings 24 can be toggled between an open mode whereby the fluid passage 23 and the formation 12 are fluidly connected, and a closed mode whereby fluid communication between the fluid passage 23 and the formation 12 is prevented. In some embodiments, sliding sleeves disposed within the casing 20 toggle the ports or openings 24 between the open mode and the closed mode.

In some embodiments, for example, the ports or openings 24 are created by perforating through the casing 20 to form perforations 24A, 24B. In some embodiments, for example, the perforating is effected by a perforating gun.

In some embodiments, for example, the perforating gun is deployed downhole via wireline, such as by, for example, being pumped downhole with fluid flow. In this respect, when the port or openings 24 are perforations created by a perforating gun deployed downhole via wireline, such as by being pumped downhole with fluid flow.

In some embodiments, for example, the perforating gun is deployed downhole via coiled tubing. In some embodiments, for example, the perforating gun is deployed using a tractor.

In some embodiments, the formation 12 is stimulated to enhance productivity of the well. In some embodiments, the formation is stimulated by hydraulic fracturing, where treatment fluid is injected into the wellbore 10 to create or expand fractures 32 in the formation 12. The treatment fluid is injected into the wellbore 10 from a source 40 of treatment fluid connected to the wellhead 50, and is conducted through the fluid passage 23 defined within the casing 20. The conducted treatment fluid is directed to the at least one zone 14 in the formation 12 through the ports or openings 24 that penetrate through the casing 20 (and, in some embodiments, for example, the cement 22).

In some embodiments, for example, the treatment fluid includes hydraulic fracturing fluid. Suitable hydraulic fracturing fluid includes water, water with various additives for friction reduction and viscosity such as polyacrylamide, guar, derivitized guar, xyanthan, and crosslinked polymers using various crosslinking agents, such as borate, metal salts of titanium, antimony, alumina, for viscosity improvements, as well as various hydrocarbons both volatile and non-volatile, such as lease crude, diesel, liquid propane, ethane and compressed natural gas, and natural gas liquids. In some embodiments, for example, various compressed gases, such as nitrogen and/or CO2, may also be added, to water or other liquid materials. In some embodiments, for example, the treatment fluid may also include proppant.

As the treatment fluid is injected, the pressure in the formation 12 increases. Once the pressure in the formation reaches a pressure that is greater than a fracture pressure, fractures 32 will form in the formation 12. Injecting additional treatment fluid will cause the fractures 32 to expand. The injecting of the treatment fluid is then suspended.

After the injecting of treatment fluid from the source 40 is suspended, the well is flowed back such that production of hydrocarbons from the subterranean formation 12 may be initiated.

Figure 2:
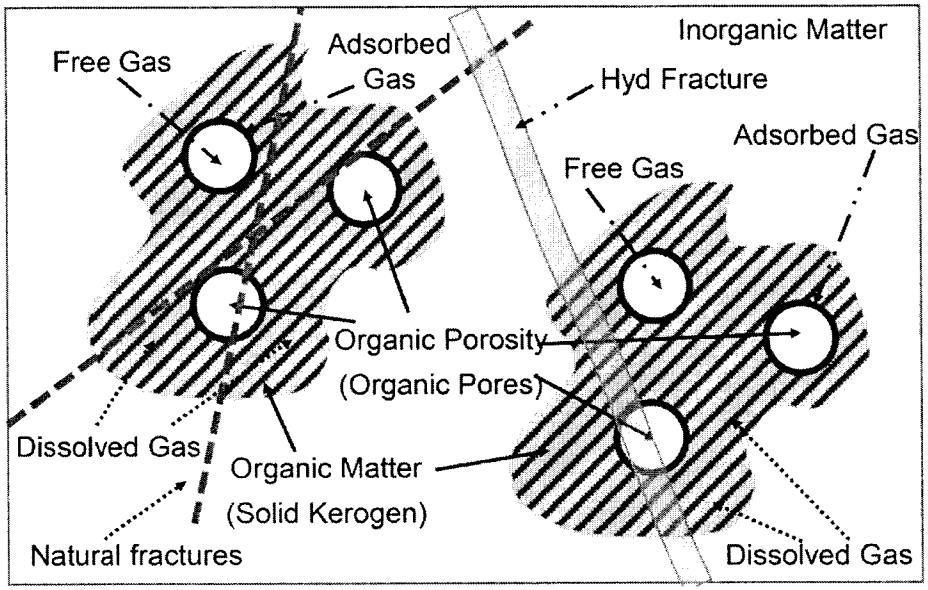
FIG. 2 is a schematic diagram of hydrocarbons disposed in a shale formation.

In some embodiments, the formation 12 is a low permeability reservoir or ultra-low permeability reservoir, such as a shale gas reservoir or tight gas reservoir. In such formations, gaseous hydrocarbons can be produced from free gases (in the organic matrix, inorganic matrix, or fractures), adsorbed gases (at the surface of solid organic matter, such as kerogen, disposed in the formation), dissolved (within the solid organic matter) gases, or any combination thereof. A schematic diagram illustrating sources of gaseous hydrocarbons in a shale formation is provided by B. Lopez and R. Aguilera, "Sorption-Dependent Permeability of Shales" (Paper delivered at SPE/CSUR Unconventional Resources Conference, Calgary, 20-22 Oct. 2015), SPE Paper 175922 (FIG. 2). The total gaseous hydrocarbons in the shale formation, $G_t$, is the sum of free gas stored in hydraulically-effected fractures, organic matrix (i.e. pores in solid organic matter) and inorganic matrix (i.e. natural micro fractures and slots), the adsorbed gas and the dissolved gas:

$$G_t=G_f+G_m+G_a+G_d \quad (1)$$

Figure 3:
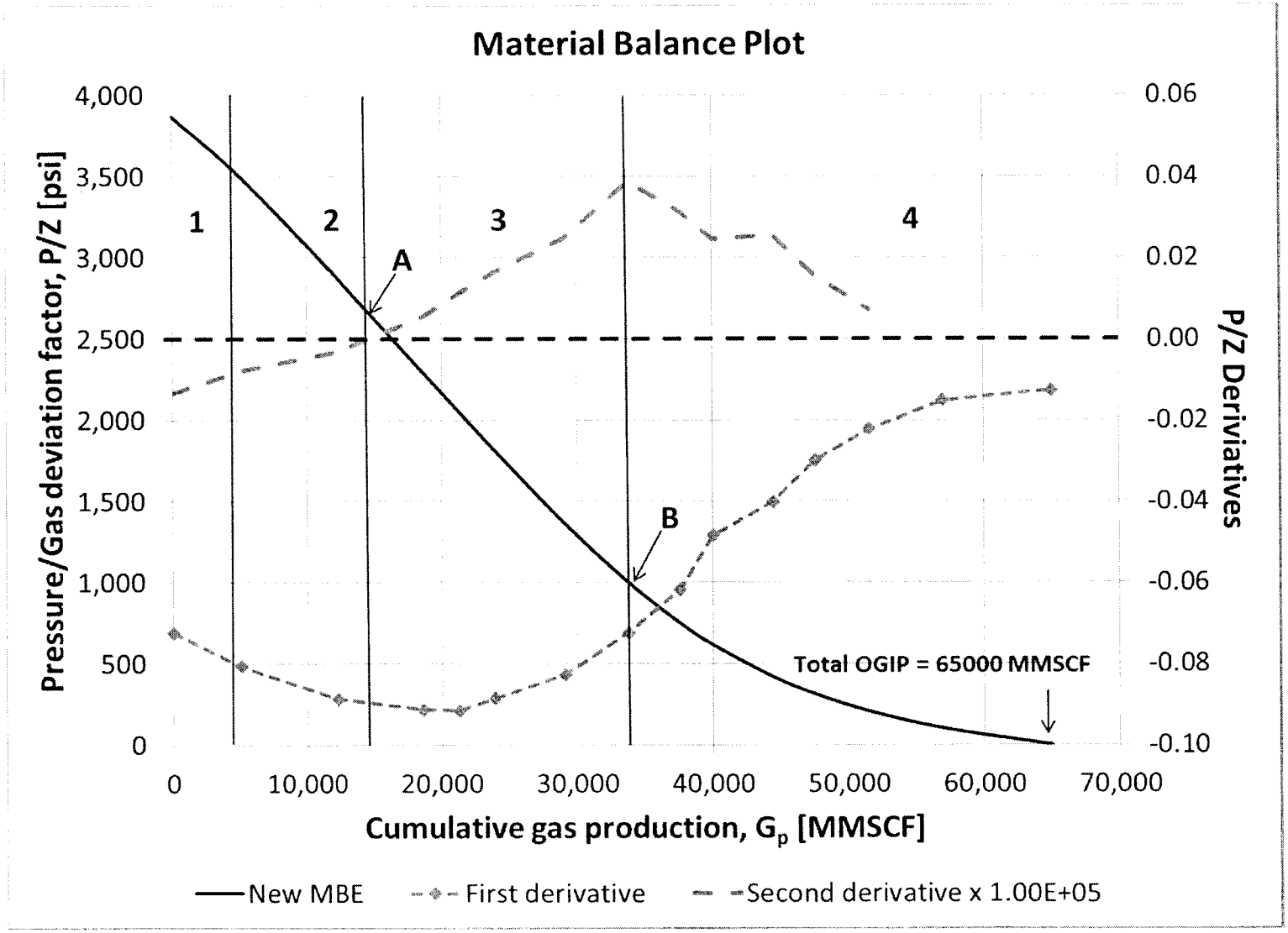
FIG. 3 is a chart showing the stages of hydrocarbon production in a shale gas formation.

Having reference to FIG. 3, the production of hydrocarbons from shale gas reservoirs typically proceeds in four stages: 1) production dominated by free gas from hydraulically-effected fractures and free gas from pores in the solid organic matter that are in fluid communication with the fractures, 2) production dominated by free gas from the pores of the inorganic matrix (i.e. in the natural micro fractures and slots in the rock of the formation, such as sandstone) as the hydraulically-effected fractures start are closing, 3) production dominated by desorption of gas adsorbed at the surface of the solid organic matter and 4) production dominated by diffusion of dissolved gas out of the solid organic matter.

In some embodiments, free gas stored in hydraulically-effected fractures 32, and free gas stored in the pores of the solid organic matter that is in fluid communication with the fractures 32 initially contribute to the majority of the gas production from the well 10. Due to the high permeability of the fractures 32, the free gas stored in the fractures 32 and in the organic pores, is easily produced to the wellbore fluid passage 23. As hydrocarbons are produced, the pore pressure decreases. The pore pressure opposes stresses exerting compressive forces that urge the closure of the fractures. With decreasing pore pressure, the opposition to the compressive forces is reduced, leading to reduced porosity and permeability of the fractures. This in turn leads to a decrease in the productivity from the fractures.

As the fractures 32 start closing, the production becomes dominated by free gas stored in the pores of the inorganic matrix (i.e. in the natural fractures and slots). Similar to the fractures 32, stresses exert compressive forces on the inorganic matrix, which are opposed by the formation pressure. With decreasing formation pressure, the opposition to the compressive forces is reduced, leading to reduced porosity and permeability of the inorganic matrix. This in turn leads to a decrease in the productivity from the inorganic matrix.

Figure 4:
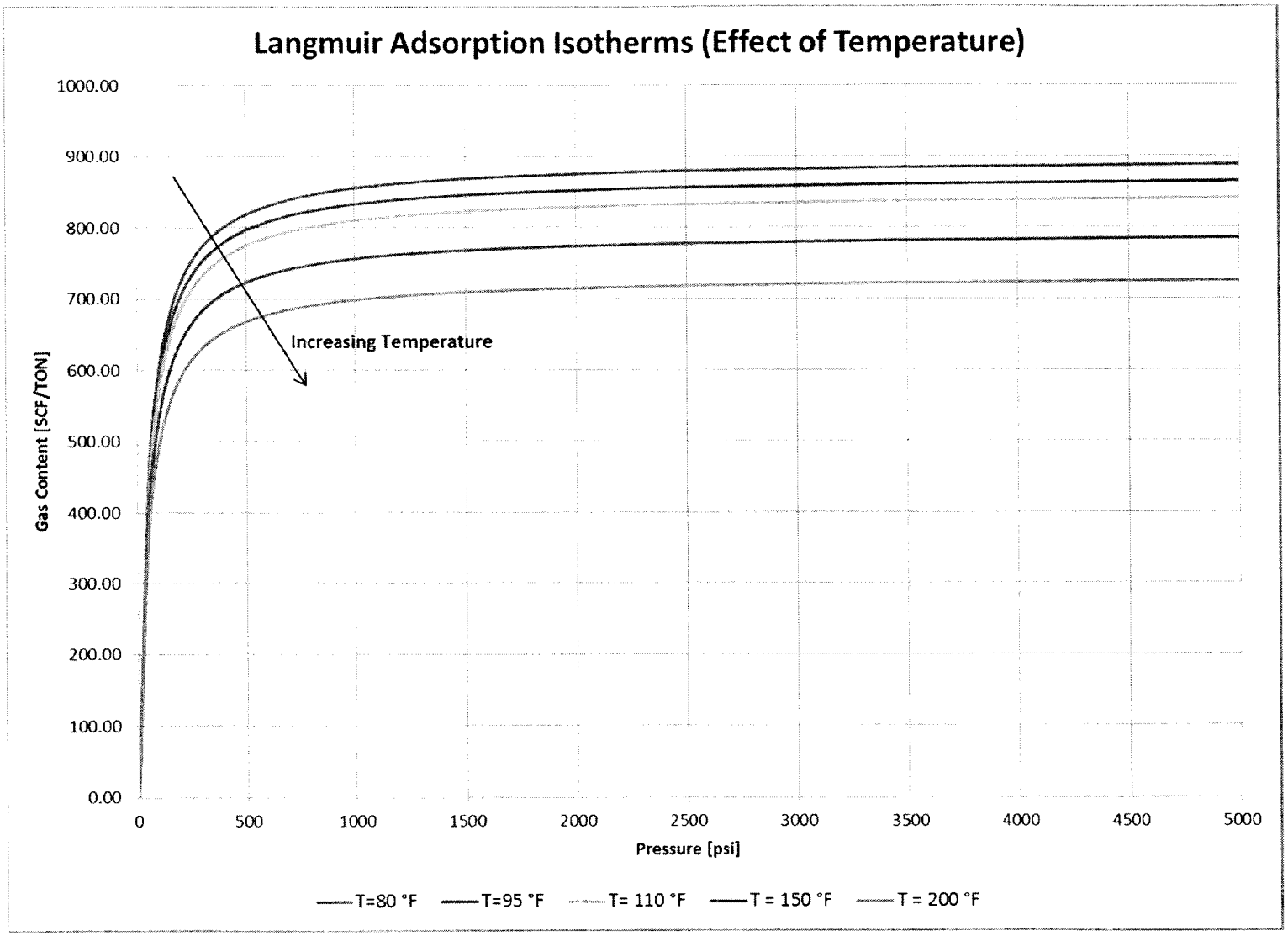
FIG. 4 is a chart showing the effect of temperature on the gas adsorbed on a surface.

As the production from the fractures 32 and the matrix decreases with ongoing production, the relative production rates of hydrocarbons from gas adsorbed on the solid organic matter and gases dissolved in the solid organic matter increases. The gas adsorbed on the surface of the solid organic matter can be approximated by an adsorption model, such as the Langmuir adsorption isotherm or the BET adsorption model. The amount of gas that can adsorb onto a surface decreases with increasing temperature (see, for example, FIG. 4). The rate of desorption will increase as the pressure in the reservoir decreases. As the surface of the solid organic matter is desorbed of gas, the gases dissolved in the bulk of the solid organic matter will diffuse to the surface, allowing for further desorption.

In one aspect, after a first hydraulic fracturing of a formation produces a first conditioned formation, and while hydrocarbons are being produced from the first conditioned formation, a well is monitored for a predetermined wellbore characteristic. The predetermined wellbore characteristic is based on at least a pressure within the first conditioned formation. After detecting the predetermined wellbore characteristic, a second hydraulic fracturing of the formation is effected to produce a second conditioned formation. After the second hydraulic fracturing of the formation, hydrocarbons are produced from the formation.

Figure 5:
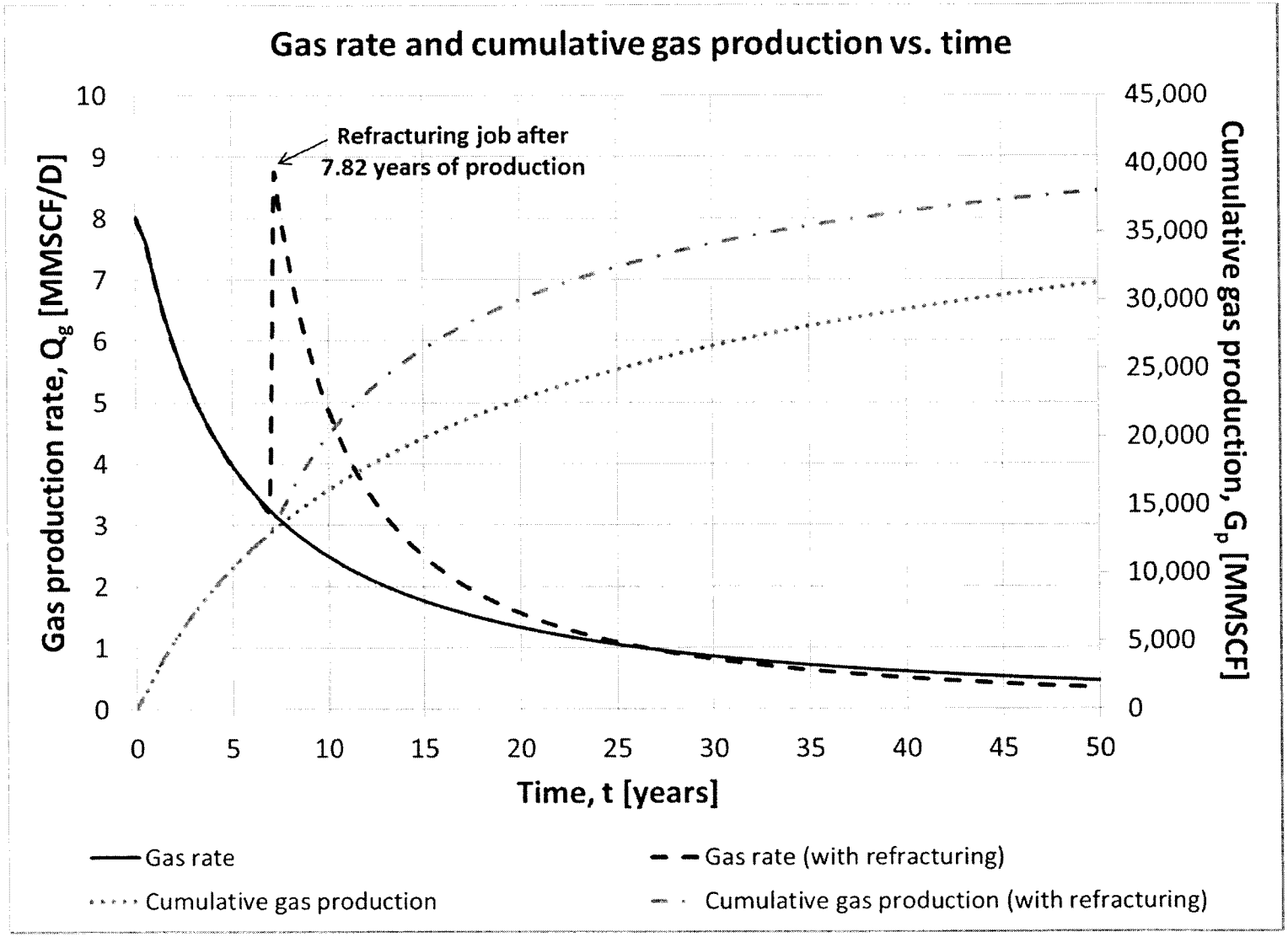
FIG. 5 is a chart showing the effect of a second hydraulic fracturing on gas production rates.
Figure 6:
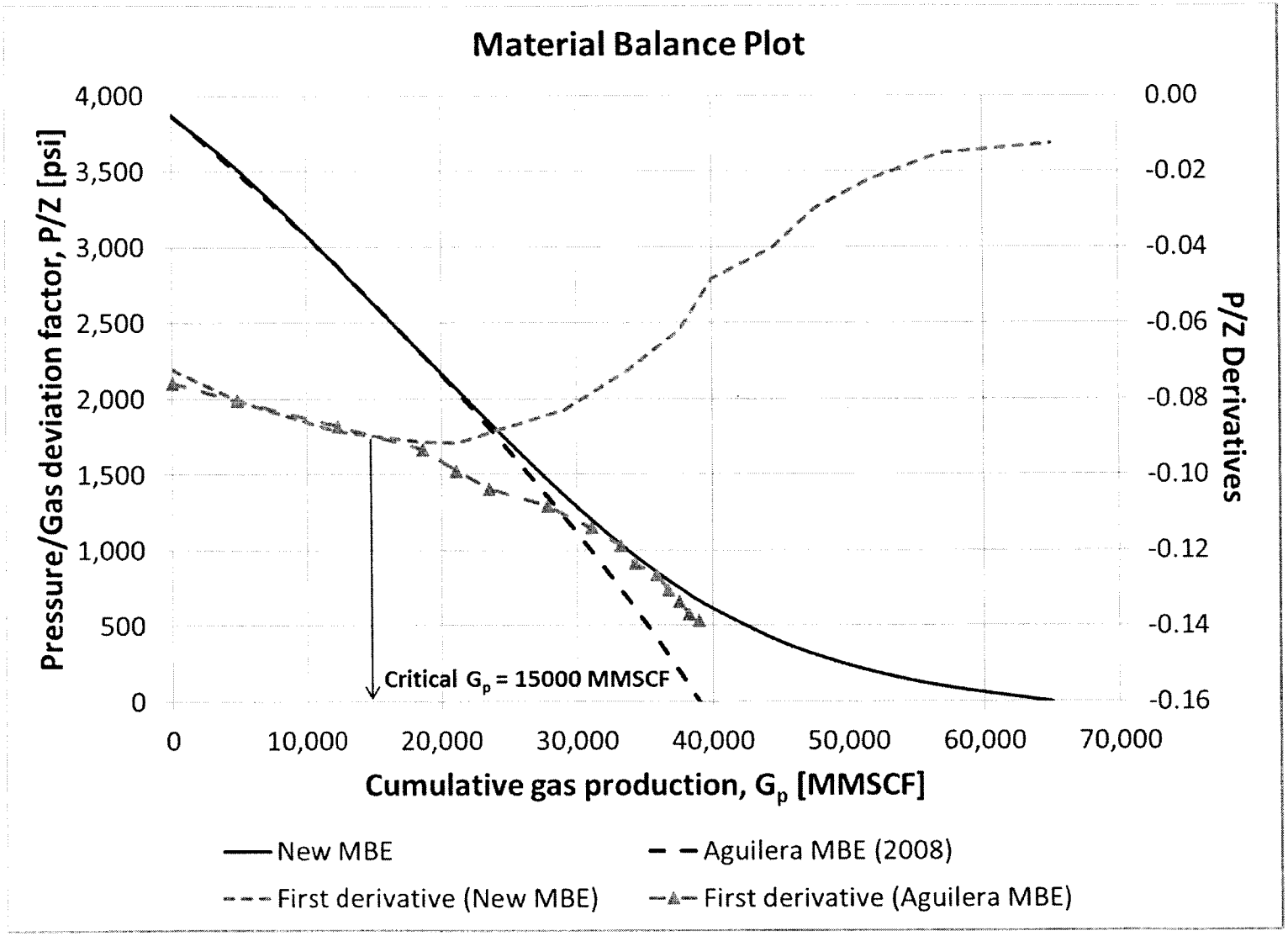
FIG. 6 is a chart showing the first derivative P/Z with respect to $G_p$ according to two different calculations.

In some embodiments, the second hydraulic fracturing increases the production rate of the well. As seen in FIG. 5, the gas production rate is increased when the formation is subject to a second hydraulic fracturing. In some embodiments, the maximum volumetric production rate of the second conditioned formation is higher than the maximum volumetric production rate of the first conditioned formation. Consequently, due to higher production rates, the cumulative gas produced at a given time may be higher in a formation subject to a second hydraulic fracturing as compared to the cumulative gas produced at the same time in a formation not subject to a second hydraulic fracturing. The second hydraulic fracturing helps maintain economic production rates in the well. In some embodiments, the second hydraulic fracturing increases the recovery of the original gas in place.

In some embodiments, the second hydraulic fracturing re-opens the fractures effected by the first hydraulic fracturing but does not effect additional fractures in the formation. In such embodiments, the maximum production rate of the second conditioned formation will be less than the maximum production rate of the first conditioned formation. In other embodiments, the second hydraulic fracturing re-opens the fractures effected by the first hydraulic fracturing and effects new fractures in the formation. In such embodiments, the maximum production rate of the second conditioned formation may exceed the maximum production rate of the first conditioned formation. In some embodiments, the maximum volumetric rate of production of hydrocarbons from the second conditioned formation is at least 10% of the maximum volumetric rate of production of hydrocarbons from the first conditioned formation. In some embodiments, for example, the maximum volumetric rate of production of hydrocarbons from the second conditioned formation is at least 100% of the maximum volumetric rate of production of hydrocarbons from the first conditioned formation.

In some embodiments, the predetermined wellbore characteristic is determined according to a material balance equation that calculates the contribution of free, adsorbed and dissolved gases in stress-sensitive shale gas reservoirs (see also D. Orozco and R. Aguilera, "A Material Balance Equation for Stress-Sensitive Shale Gas Reservoirs Considering the Contribution of Free, Adsorbed and Dissolved Gas" (Paper delivered at the SPE/CSUR Unconventional Resources Conference, Calgary, 20-22 Oct. 2015), SPE Paper 175964, herein incorporated by reference). In some embodiments, the material balance equation is given by:

$$\frac{G_p}{G_t} = 1 - \frac{P/Z'}{P_i/Z_i} \tag{2}$$

where Z' is a gas deviation factor defined as:

$$Z' = Z\left[1 - \omega_a - \omega_d - (\omega_m C' + \omega C'')\Delta P + \left(\frac{\omega_m B_g \rho_b V_L}{35.315\phi_{mt}(1 - S_{wm})}\frac{P}{P_L + P}\right) + \left(\frac{1.057\omega_m C_{(P)} B_g}{\phi_{mt}(1 - S_{wm})}\right)\left(\frac{TOC}{100\rho_r} - \phi_{ads_c} - \phi_{org}\right)\right]^{-1} \tag{3}$$

In these equations:

$G_p$=cumulative gas production, MMSCF $G_t$=total Original Gas in Place, MMSCF

P=average reservoir pressure, psia or MPa $P_i$=initial reservoir pressure, psi

ω=Fraction of OGIP initially stored in fractures, fraction, where $$\omega = \frac{G_f}{G_t}$$

$\omega_a$=Fraction of OGIP initially adsorbed in the organic matter, fraction, where $$\omega_a = \frac{G_a}{G_t}$$

$\omega_d$=Fraction of OGIP initially dissolved in the solid organic matter, fraction, where $$\omega_d = \frac{G_d}{G_t}$$

$\omega_m$=Fraction of OGIP initially stored in matrix, fraction, where $$\omega_m = \frac{G_m}{G_t}$$

C'=effective matrix compressibility, $psi^{-1}$

C"=effective fracture compressibility, $psi^{-1}$

ΔP=pressure drop in the reservoir given by $P_i$−P, psi $B_g$=gas formation volume factor, RCF/SCF $\rho_b$=shale bulk density, $g/cm^3$ $V_L$=Langmuir volume, SCF/ton $\phi_{mt}$=total matrix porosity, fraction $S_{wm}$=average water saturation in matrix, fraction $P_L$=Langmuir pressure, psi $C_{(P)}$=methane solubility (or concentration) in the solid organic matter, $m^3$ of gas at NTP/$m^3$ of solid organic matter (or $ft^3$ of gas at NTP/$ft^3$ of solid organic matter)

TOC=Total Organic Carbon, % weight $\rho_r$=relative density of the solid organic matter compared to the shale bulk density $\phi_{ads_c}$=adsorbed porosity scaled to the bulk volume of the composite system, fraction $\phi_{org}$=organic porosity scaled to the bulk volume of the composite system, fraction The pressures vary widely depending on the type of reservoir and depth.

In some embodiments, at least one core/rock sample or well log of the formation 12 is analyzed to determine the porosities associated with fractures, the inorganic and organic matrices, and adsorbed gases, within the rock sample(s). The rock sample(s) can be obtained from one or more locations in the formation. In some embodiments, the analysis of the rock samples may include borehole logging of one or more wells in the target geological formation.

Initially, the production is dominated by the free gas from the hydraulically-effected fractures and the pores of the solid organic material in fluid communication with the hydraulically-effected fractures. As the formation pressure decreases due to production, the opposition to compressive forces urging the closure of the hydraulically-effected fractures is reduced, thereby decreasing the production from the hydraulically-effected fractures and the pores of the solid organic material in fluid communication with the hydraulically-effected fractures. The rate at which compressive forces affect production from the fractures and the matrix increases. The second derivative of P/Z with respect to $G_p$ will accordingly exhibit a negative value.

When the hydraulically-effected fractures are substantially or fully closed due to the compressive forces, the production is dominated by the free gas from the pores of the inorganic matrix (e.g. in natural micro fractures and slots). With reducing formation pressure due to production, the opposition to the compressive forces urging the closure of the porosity is decreased, thereby decreasing the production from the inorganic matrix. The rate at which compressive forces affect production from the inorganic matrix increases. The second derivative of P/Z with respect to $G_p$ will accordingly exhibit a negative value. The absolute value of the slope of the P/Z vs $G_p$ plot increases as the pores of the inorganic matrix begin closing.

As production continues and the pressure in the reservoir decreases further, the rate at which gases desorb from the solid organic matter surface increases (e.g. characteristic of the third stage of production). The production of hydrocarbons due to desorption mechanism contributes to the production of gases such that the second derivative of P/Z with respect to $G_p$ increases. The pressure at which the second derivative of P/Z with respect to $G_p$ is zero is a first transition pressure, A.

With further production, the gases adsorbed on the surface of the solid organic matter will desorb as partial pressure of the gases above the surface decreases due to production of gases from the fractures and the matrix. As the gases are desorbed from the surface, the concentration of the gases at the surface of the solid organic matter will decrease, causing a concentration gradient between the surface of the solid organic matter and the gases dissolved within the solid organic matter. The concentration gradient causes gases dissolved within the solid organic matter to diffuse to the surface of the solid organic matter. This gas can then desorb from the surface of the solid organic matter and be produced. The pressure at which the second derivative of P/Z with respect to $G_p$ is a maximum is referred to as a second transition pressure, B.

In some embodiments, the predetermined wellbore characteristic is the first transition pressure. At the first transition pressure, the production from the fractures and the matrix has decreased due to the compressive forces urging the closure of the fractures, to which there is decreased opposition as the formation pressure decreases. These compressive forces materially interfere with production of hydrocarbons from the fractures and the matrix. Further, the relative production from desorption has increased as the partial pressure of the gas is decreased due to production from the fractures and matrix. This causes the dominant mode of production to shift from production of free gases in the fractures and the matrix to the desorption of gas adsorbed at the surface of the solid organic matter.

By stimulating the formation in a second hydraulic fracturing, the formation pressure is increased. The increased formation pressure opposes the compressive forces such that hydraulically-effected fractures that were partially or fully closed may be partially or fully re-opened, or even extended. If the stimulation causes the pressure to exceed the fracture pressure, additional hydraulically-effected fractures may form, exposing additional gas in the formation that may not have been in fluid communication with the well. This increases the production rates from the fractures and matrix.

In effecting the second hydraulic fracturing, the injection of treatment fluid increases the formation pressure, such that improved fluid communication is effected between the hydrocarbons within the formation and the wellbore. The improved fluid communication is effected by, for example, at least re-opening fractures that have become closed while producing from the first conditioned formation (such as, for example, in the time period after the first hydraulic fracturing and before the second hydraulic fracturing).

In some embodiments, the second hydraulic fracturing is effected when the average reservoir pressure is within 10% of the first transition pressure, such as, for example, at a pressure of no less than 90% of the first transition pressure. In some embodiments, the second hydraulic fracturing is effected at an average reservoir pressure that is within 5% of the first transition pressure, such as, for example, at a pressure of no less than 95% of the first transition pressure. In some embodiments, the second hydraulic fracturing is effected at an average wellbore pressure that is within 1% of the first transition pressure, such as, for example, at a pressure of no less than 99% of the first transition pressure. In some embodiments, the second hydraulic fracturing is effected at the first transition pressure.

In some embodiments, the maximum pressure at which the treatment fluid is injected into the formation during the second hydraulic fracturing is at least 10% of the maximum pressure at which the treatment fluid is injected into the formation during the first hydraulic fracturing. In some embodiments, the maximum pressure at which the treatment fluid is injected into the wellbore during the second hydraulic fracturing has a gradient of at least 0.65 psi per foot of depth.

In some embodiments, the treatment fluid is injected into the wellbore during the second hydraulic fracturing for at least one (1) day. In some embodiments, the treatment fluid is injected into the wellbore during the second hydraulic fracturing for at least 0.1 days per fracturing stage.

In some embodiments, the gas initially produced from the first conditioned formation comprise: 80-90% by volume from fractures; 10-20% by volume from matrix; 5-10% by volume from adsorbed gas; and 0-5% by volume from dissolved gas; and, where no new fractures are effected by the second hydraulic fracturing, the gas initially produced from the second conditioned formation comprise: 10-20% by volume from fractures; 20-40% by volume from matrix; 30-50% by volume from adsorbed gas; 5-10% by volume from dissolved gas. In embodiments where new fractures are effected by the second hydraulic fracturing, the gas initially produced from the second conditioned formation may be similar to that of the gas initially produced from the first conditioned formation.

In some embodiments, hydraulically fracturing at about the first transition pressure reduces energy expenditure as compared to hydraulically fracturing at a pressure that is lower than the first transition pressure. At or about the first transition pressure, the fractures have sufficiently closed to materially interfere with production from the formation, and a relatively small increase in the formation pressure will urge the fractures to sufficiently re-open to facilitate a desirable rate of production. At pressures well below the first transition pressure, in some embodiments, significant energy is required to be expended to increase the formation pressure for effecting sufficient re-opening of the fractures to facilitate a desirable rate of production.

In some embodiments, a material balance equation that does not take into account the contribution of desorption and diffusion is given by (R. Aguilera, "Effect of Fracture Compressibility on Gas-In-Place Calculations of Stress-Sensitive Naturally Fractured Reservoirs", (2008) 11:2 SPE Reservoir Evaluation and Engineering):

$$\frac{G_p}{G_t} = 1 - \left(\frac{P/Z}{P_i/Z_i}\right)\{1 - [(1-\omega)C' + \omega C'')\Delta P\} \tag{4}$$

Equation (4) is similar to equation (2). However, Equation (4) does not account for the desorption of gases adsorbed on the surface of solid organic matter and the diffusion of gases to the surface from the bulk solid organic matter. As such, the difference of equation (2) and (4) represents production of gas desorbed from the solid organic matter surface and dissolved in the bulk solid organic matter.

In some embodiments, the predetermined wellbore characteristic is established when the difference between the first derivative of P/Z with respect to $G_p$ calculated using equation (2) and the first derivative of P/Z with respect to $G_p$ calculated using equation (4) is greater than a predetermined threshold (see FIG. 5), such as a difference of between 3% and 10%.

In some embodiments, the production rate of the well can be estimated using the correlations from T. Ahmed, *Reservoir Engineering Handbook,* 3d ed (Burlington, Mass.: Elsevier, 2006):

$$Q_g = C\left(\overline{P}_r^2 - P_{wf}^2\right)^n = \frac{dG_p}{dt} \tag{5}$$

In this equation:

$Q_g$=gas production rate, MMSCF/D

C=performance coefficient, MSCF/D/psi$^2$ $P_r$=average reservoir pressure

Pwf=bottomhole flowing pressure

By integrating equation (5) and monitoring the cumulative gas production, the predetermined wellbore characteristic is established at a time, $t_{refrac}$:

$$t_{refrac} = \frac{1}{C_{refrac}} \int_0^{G_{p_{refrac}}} \frac{dG_p}{\{[f(G_p)]^2 - P_{wf}^2\}^n} \tag{6}$$

In some embodiments, the formation is subject to additional hydraulic fracturing. For example, the well can be stimulated three times, four times, five times, or even more. In those embodiments where additional hydraulic fracturing is effected, the monitoring for the predetermined wellbore characteristic is restarted after production resumes after the previous hydraulic fracturing. For example, where a third hydraulic fracturing is effected, the monitoring for the predetermined wellbore characteristic is restarted after the production resumes following the second hydraulic fracturing.

In some embodiments, the hydrocarbons includes liquid hydrocarbons. In some embodiments, the formation is a tight formation or a shale formation. In some embodiments where the hydrocarbons include liquid hydrocarbons and the formation is a tight formation or a shale formation, the production of the liquid hydrocarbons is effected by solution gas drive or gas cap drive.

In those embodiments where liquid hydrocarbons are produced via solution gas drive, production can be divided into 4 stages: 1) production while undersaturated; 2) production while saturated but the free gas is immobile; 3) production while saturated and the free gas is mobile, with an increasing gas-oil ratio (GOR); and 4) production while saturated and the free gas is mobile with decreasing GOR.

Initially, at stage 1 of production is dominated by bulk expansion of reservoir rocks and liquids, the formation pressure is above the bubble point of dissolved gas such that there is no gas phase present. The produced GOR is equal to the initial dissolved GOR. As the liquid hydrocarbons is produced, the pressure in the formation decreases.

Continuing production of the hydrocarbons by bulk expansion of the reservoir rocks and liquids eventually lowers the formation pressure until it reaches the bubble point of the gas, where gas is evolved from the liquid hydrocarbons. The bubble point is the transition between stage 1 and stage 2. In stage 2, dissolved gas is evolved but entrained within the liquid hydrocarbons. The evolution of gas offsets counteracts some of the pressure loss in the formation due to production.

Further production lowers the formation pressure such that it transitions from stage 2 to stage 3 of production when the evolved gas is no longer entrained, but becomes mobile. At stage 3, the GOR of the produced hydrocarbons start increasing and free gas is produced alongside the liquid hydrocarbons.

Eventually, the production lowers the formation pressure such that it transitions from stage 3 to stage 4 of production, when the GOR of the produced hydrocarbons starts to decrease.

In those embodiments where hydrocarbons are produced via gas cap drive, both liquid and gaseous hydrocarbons phases are initially present. The formation pressure is initially at a pressure lower than a bubble point of gas dissolved in the liquid hydrocarbons such the phases are in equilibrium. The gaseous phase is disposed above the liquid phase. As the liquid hydrocarbons are produced, the formation pressure drops and gases dissolved in the liquid hydrocarbons are evolved. The evolved gas is entrained in the liquid hydrocarbons, escapes to the gas phase, or both.

A similar mathematical model can be derived and applied to determine a critical pressure at which a refracking is implemented within a reservoir containing liquid hydrocarbons.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

APPENDIX

Derivation of the MBE for Stress-Sensitive Shale Gas Reservoirs Considering the Contribution of Free, Adsorbed and Dissolved Gas The Total Original Gas in Place $G_t$ is given by the summation of free gas stored in matrix (organic and inorganic) and fractures (natural and hydraulic), adsorbed gas and dissolved gas.

$$G_m+G_f+G_a+G_d=G_t \tag{A-1}$$

Dividing by $G_t$:

$$\frac{G_m}{G_t} + \frac{G_f}{G_t} + \frac{G_a}{G_t} + \frac{G_d}{G_t} = \frac{G_t}{G_t} \tag{A-2}$$

$$\omega_m + \omega + \omega_a + \omega_d = 1 \tag{A-3}$$

In the absence of water influx and water production, the material balance for a fractured shale gas reservoir can be written as follows:

$$G_pB_g = (G_m + G_f)(B_g - B_{gi}) + G_m\left(\frac{C_wS_{wm} + C_m}{1 - S_{wm}}\right)B_{gi}\Delta P + G_f\left(\frac{C_wS_{wf} + C_f}{1 - S_{wf}}\right)B_{gi}\Delta P + G_{ap}B_g + G_{dp}B_g \quad \text{(A-4)}$$

Cumulative gas production due to the desorption mechanisms of the rock is given by:

$$G_{ap}=G_a(P_i)-G_a(P) \quad \text{(A-5)}$$

The adsorbed gas volume at initial reservoir pressure is the same as the adsorbed OGIP:

$$G_a(P_i)=G_a \quad \text{(A-6)}$$

The adsorbed gas volume at average reservoir pressure is expressed as (Cabrapán et al., 2014):

$$G_a(P) = \frac{V_{rock}}{35.315}\rho_b\frac{V_LP}{P_L + P} \quad \text{(A-7)}$$

The rock volume can be expressed in terms of total matrix porosity (organic and inorganic):

$$V_{rock} = \frac{V_{pmt}}{\phi_{mt}} = \frac{G_mB_{gi}}{\phi_{mt}(1 - S_{wm})} \quad \text{(A-8)}$$

Note that $S_{wm}$ corresponds to the average water saturation attached to total matrix porosity. Total matrix porosity is the term that groups organic and inorganic matrix porosities:

$$\emptyset_{mt}=\emptyset_m+\emptyset_{org} \quad \text{(A-9)}$$

Thus:

$$G_a(P) = \frac{G_m\rho_bB_{gi}}{35.315\phi_{mt}(1 - S_{wm})}\frac{V_LP}{P_L + P} \quad \text{(A-10)}$$

Hence:

$$G_{ap} = G_a - \frac{G_m\rho_bB_{gi}V_L}{35.315\phi_{mt}(1 - S_{wm})}\frac{P}{P_L + P} \quad \text{(A-11)}$$

Cumulative gas production from dissolved gas, $G_{dp}$, can be expressed as the difference between the dissolved gas volume at initial reservoir pressure and the dissolved gas volume at average reservoir pressure, i.e.:

$$G_{dp}=G_d(P_i)-G_d(P) \quad \text{(A-12)}$$

The dissolved gas volume at initial reservoir pressure, $G_d(P_i)$, is the same as the dissolved OGIP:

$$G_d(P_i)=G_d \quad \text{(A-13)}$$

The dissolved gas volume at average reservoir pressure, $G_d(P)$, can be written as the product of the methane concentration in the solid kerogen, $C_{(P)}$, and the total volume of solid kerogen, $V_{sk}$.

$$G_d(P)=C_{(P)}V_{sk} \quad \text{(A-14)}$$

The methane concentration in the solid kerogen, $C_{(P)}$, is a function of reservoir pressure and temperature, as proposed by Swami et al. (2013). The authors assume that methane solubility in the solid kerogen is the same as in bitumen, given the similarity between kerogen and bitumen.

$$C_{(P)} = b_1 + b_2P + b_3\frac{P}{T} + b_4\left(\frac{P}{T}\right)^2 \quad \text{(A-15)}$$

Where: $b_1$=−0.018931, $b_2$=−0.85048, $b_3$=827.26 and $b_4$=−635.26. P is pressure expressed in MPa and T is temperature in Kelvin. In the previous equation, $C_{(P)}$ is given in $m^3$ of gas at Normal Temperature and Pressure (NTP)/$m^3$ of kerogen (or $ft^3$ of gas at NTP/ft of kerogen). For expressing the gas concentration in volume of gas at standard conditions (SC) of temperature and pressure, i.e., 60° F. (288.56 K) and 14.7 psia, the Charles' Law for gases can be applied:

$$V_{NTP}T_{SC} = V_{SC}T_{NTP} \quad \text{(A-16)}$$

$$V_{SC} = \left(\frac{T_{SC}}{T_{NTP}}\right)V_{NTP} = \left(\frac{288.56\text{ K}}{273\text{ K}}\right)V_{NTP} \quad \text{(A-17)}$$

$$V_{SC} = 1.057V_{NTP} \quad \text{(A-18)}$$

As observed, the concentration $C_{(P)}$ must be multiplied by 1.057 in order to convert it to standard volume of dissolved gas.

Total volume of solid kerogen, $V_{sk}$, can be written as the product of rock bulk volume, $V_{rock}$, and fractional volume of solid kerogen, $V_{diff}$.

$$V_{sk}=V_{rock}V_{diff} \quad \text{(A-19)}$$

The total fractional volume of kerogen, $V_{tker}$, defined by Lopez and Aguilera (2014), is made up of adsorbed porosity, organic porosity and fractional volume of solid kerogen, i.e.:

$$V_{tker}=\emptyset_{ads_c}+\emptyset_{org}+V_{diff} \quad \text{(A-20)}$$

Therefore:

$$V_{diff}=V_{tker}-\emptyset_{ads_c}-\emptyset_{org} \quad \text{(A-21)}$$

Thus, the total volume of solid kerogen is given by:

$$V_{sk} = \frac{G_mB_{gi}}{\phi_{mt}(1 - S_{wm})}(V_{tker} - \phi_{ads_c} - \phi_{org}) \quad \text{(A-22)}$$

The total fractional volume of kerogen can be expressed in turn in terms of the shale Total Organic Carbon (TOC) and the relative density of kerogen, ρr (Wu and Aguilera, 2012):

$$V_{tker} = \frac{TOC}{100\rho_r} \quad \text{(A-23)}$$

The relative density of kerogen is given by:

$$\rho_r = \frac{\rho_{ko}}{\rho_b} \quad \text{(A-24)}$$

Where $\rho_{ko}$ is the kerogen density and $\rho_b$ is the shale bulk density. $\rho_r$ is normally assumed to be 0.50, computed from a kerogen density equal to 1.325 g/cm$^3$ and a shale bulk density equal to 2.65 g/cm$^3$ (Wu and Aguilera, 2012). Thus, the total volume of solid kerogen can be expressed as:

$$V_{sk} = \frac{G_m B_{gi}}{\phi_{mt}(1-S_{wm})}\left(\frac{TOC}{100\rho_r} - \phi_{ads_c} - \phi_{org}\right) \tag{A-25}$$

Now the dissolved gas volume at average reservoir pressure, $G_d(P)$, is expressed using the equation derived for $V_{sk}$:

$$G_d(P) = 1.057C_{(P)}\left[\frac{G_m B_{gi}}{\phi_{mt}(1-S_{wm})}\left(\frac{TOC}{100\rho_r} - \phi_{ads_c} - \phi_{org}\right)\right] \tag{A-26}$$

Thus:

$$G_{dp} = G_d - 1.057C_{(P)}\left[\frac{G_m B_{gi}}{\phi_{mt}(1-S_{wm})}\left(\frac{TOC}{100\rho_r} - \phi_{ads_c} - \phi_{org}\right)\right] \tag{A-27}$$

The material balance for a fractured shale gas reservoir can be written then as follows:

$$\begin{aligned} G_p B_g = {} & (G_m + G_f)(B_g - B_{gi}) + \\ & G_m\left(\frac{C_w S_{wm} + C_m}{1-S_{wm}}\right)B_{gi}\Delta P + G_f\left(\frac{C_w S_{wf} + C_f}{1-S_{wf}}\right)B_{gi}\Delta P + \\ & \left\{G_a - \left[\frac{G_m B_{gi}\rho_b V_L}{35.315\phi_{mt}(1-S_{wm})}\frac{P}{P_L+P}\right]\right\}B_g + \\ & \left\{G_d - 1.057C_{(P)}\left[\frac{G_m B_{gi}}{\phi_{mt}(1-S_{wm})}\left(\frac{TOC}{100\rho_r} - \phi_{ads_c} - \phi_{org}\right)\right]\right\}B_g \end{aligned} \tag{A-28}$$

Dividing by $G_t$ and $B_g$:

$$\begin{aligned} \frac{G_p}{G_t} = {} & \left(\frac{G_m + G_f}{G_t}\right) - \left[\left(\frac{B_{gi}}{B_g}\right)\left(\frac{G_m + G_f}{G_t}\right)\right] + \\ & \left[\left(\frac{B_{gi}}{B_g}\right)\left(\frac{G_m}{G_t}\right)\left(\frac{C_w S_{wm} + C_m}{1-S_{wm}}\right)\Delta P\right] + \\ & \left[\left(\frac{B_{gi}}{B_g}\right)\left(\frac{G_f}{G_t}\right)\left(\frac{C_w S_{wg} + C_f}{1-S_{wf}}\right)\Delta P\right] + \left(\frac{G_a}{G_t}\right) - \\ & \left\{\left(\frac{G_m}{G_t}\right)\left[\frac{B_{gi}\rho_b V_L}{35.315\phi_{mt}(1-S_{wm})}\frac{P}{P_L+P}\right]\right\} + \left(\frac{G_d}{G_t}\right) - \\ & \left\{\left(\frac{G_m}{G_t}\right)\left[\frac{1.057C_{(P)}B_{gi}}{\phi_{mt}(1-s_{wm})}\right]\left(\frac{TOC}{100\rho_r} - \phi_{ads__c} - \phi_{org}\right)\right\} \end{aligned} \tag{A-29}$$

Recall:

Effective matrix compressibility (C') and effective fracture compressibility (C") are defined by:

$$C' = \frac{C_w S_{wm} + C_m}{1-S_{wm}} \tag{A-30}$$

$$C'' = \frac{C_w S_{wf} + C_f}{1-S_{wf}} \tag{A-31}$$

The ratio of initial gas formation volume factor to gas formation volume factor at average reservoir pressure can be expressed as:

$$\frac{B_{gi}}{B_g} = \frac{(P/Z)}{(P_i/Z_i)} \tag{A-32}$$

The contributions of each storage mechanism to total OGIP are given by:

$$\frac{G_m}{G_t} = \omega_m;\ \frac{G_f}{G_t} = \omega;\ \frac{G_a}{G_t} = \omega_a;\ \frac{G_d}{G_t} = \omega_d \tag{A-33}$$

Also, from Equation A-3:

$$\omega_m + \omega = 1 - \omega_a - \omega_d \tag{A-34}$$

Substituting:

$$\begin{aligned} \frac{G_p}{G_t} = {} & 1 - \omega_a - \omega_d - \left[\left(\frac{P/Z}{P_i/Z_i}\right)(1-\omega_a-\omega_d)\right] + \\ & \left(\frac{P/Z}{P_i/Z_i}\right)\omega_m C'\Delta P + \left(\frac{P/Z}{P_i/Z_i}\right)\omega C''\Delta P + \omega_a - \\ & \left\{\omega_m\left(\frac{P/Z}{P_i/Z_i}\right)\left[\frac{B_g\rho_b V_L}{35.315\phi_{mt}(1-S_{wm})}\frac{P}{P_L+P}\right]\right\} + \omega_d - \\ & \left\{\omega_m\left(\frac{P/Z}{P_i/Z_i}\right)\left[\frac{1.057C_{(P)}B_g}{\phi_{mt}(1-S_{wm})}\right]\left(\frac{TOC}{100\rho_r} - \phi_{ads__c} - \phi_{org}\right)\right\} \end{aligned} \tag{A-35}$$

Therefore:

$$\begin{aligned} \frac{G_p}{G_t} = {} & 1 - \left(\frac{P/Z}{P_i/Z_i}\right) \\ & \left\{1 - \omega_a - \omega_d - (\omega_m C' + \omega C'')\Delta P + \left[\frac{\omega_m B_g\rho_b V_L}{35.315\phi_{mt}(1-S_{wm})}\right.\right. \\ & \left.\left.\frac{P}{P_L+P}\right] + \left[\frac{1.057\omega_m C_{(P)}B_g}{\phi_{mt}(1-S_{wm})}\right]\left(\frac{TOC}{100\rho_r} - \phi_{ads__c} - \phi_{org}\right)\right\} \end{aligned} \tag{A-36}$$

Defining Z' as follows:

$$\begin{aligned} Z' = Z\Big\{ & 1 - \omega_a - \omega_d - (\omega_m C' + \omega C'')\Delta P + \left[\frac{\omega_m B_g\rho_b V_L}{35.315\phi_{mt}(1-S_{wm})}\right. \\ & \left.\frac{P}{P_L+P}\right] + \left[\frac{1.057\omega_m C_{(P)}B_g}{\phi_{mt}(1-S_{wm})}\right]\left(\frac{TOC}{100\rho_r} - \phi_{ads__c} - \phi_{org}\right)\Big\} \end{aligned} \tag{A-37}$$

Finally:

$$\frac{G_p}{G_t} = 1 - \frac{P/Z'}{P_i/Z_i} \tag{A-38}$$

This is the new MBE for shale gas reservoirs presented in the main body of the text.

What is claimed is:

1. A method for capturing hydrocarbons from a formation comprising:

after a first hydraulic fracturing of a formation to produce a first conditioned formation, and while hydrocarbons are being produced from the first conditioned formation: monitoring for a predetermined wellbore characteristic, wherein the predetermined wellbore characteristic is based on at least a pressure within the first conditioned formation;

after detecting the predetermined wellbore characteristic, effecting a second hydraulic fracturing of the formation to produce a second conditioned formation, wherein the predetermined wellbore characteristic is established when $$\frac{\partial^2 \frac{P}{Z}}{\partial G_p^2} = 0,$$

wherein:

$$\frac{G_p}{G_t} = 1 - \frac{P/Z'}{P_i/Z_i} \text{ and } Z' = Z\left[1 - \omega_a - \omega_d - (\omega_m C' + \omega C'')\Delta P + \left(\frac{\omega_m B_g \rho_b V_L}{35.315\phi_{mt}(1 - S_{wm})}\frac{P}{P_L + P}\right) + \left(\frac{1.057\omega_m C_{(P)} B_g}{\phi_{mt}(1 - S_{wm})}\right)\left(\frac{TOC}{100\rho_r} - \phi_{ads_c} - \phi_{org}\right)\right]^{-1},$$

wherein Z' is a gas deviation factor; $G_p$ is cumulative gas production, $G_t$ is total Original Gas in Place; P is average reservoir pressure; $P_i$ is initial reservoir pressure; ω is Fraction of Original Gas-In-Place (OGIP) initially stored in fractures; $\omega_a$ is Fraction of OGIP initially adsorbed in the organic matter; $\omega_d$ is Fraction of OGIP initially dissolved in the solid organic matter; $\omega_m$ is Fraction of OGIP initially stored in matrix; C' effective matrix compressibility; C" is effective fracture compressibility; ΔP is pressure drop in the reservoir given by $P_i$–P; $B_g$ gas formation volume factor; $\rho_b$ is shale bulk density; $V_L$ is Langmuir volume; $\phi_{mt}$ is total matrix porosity; $S_{wm}$ is average water saturation in matrix; $P_L$ is Langmuir pressure; $C_{(P)}$ is methane solubility (or concentration) in the solid organic matter; TOC is Total Organic Carbon; $\rho_r$ is relative density of the solid organic matter compared to the shale bulk density; $\phi_{ads_c}$ is adsorbed porosity scaled to the bulk volume of the composite system; $\phi_{org}$ is organic porosity scaled to the bulk volume of the composite system.

2. A method for capturing hydrocarbons from a formation comprising:

after a first hydraulic fracturing of a formation to produce a first conditioned formation, and while hydrocarbons are being produced from the first conditioned formation: monitoring for a predetermined wellbore characteristic, wherein the predetermined wellbore characteristic is based on at least a pressure within the first conditioned formation;

after detecting the predetermined wellbore characteristic, effecting a second hydraulic fracturing of the formation to produce a second conditioned formation, wherein the predetermined wellbore characteristic is established when the difference between:

a) $\frac{\partial \frac{P}{Z}}{\partial G_p'}$ where:

$$\frac{G_p}{G_t} = 1 - \frac{P/Z'}{P_i/Z_i} \text{ and}$$

$$Z' = Z\left[1 - \omega_a - \omega_d - (\omega_m C' + \omega C'')\Delta P + \left(\frac{\omega_m B_g \rho_b V_L}{35.315\phi_{mt}(1 - S_{wm})}\frac{P}{P_L + P}\right) + \left(\frac{1.057\omega_m C_{(P)} B_g}{\phi_{mt}(1 - S_{wm})}\right)\left(\frac{TOC}{100\rho_r} - \phi_{ads_c} - \phi_{org}\right)\right]^{-1}; \text{ and}$$

b) $\frac{\partial \frac{P}{Z}}{\partial G_p'}$ where:

$$\frac{G_p}{G_t} = 1 - \left(\frac{P/Z}{P_i/Z_i}\right)\{1 - [(1 - \omega)C' + \omega C'']\Delta P\}$$

differ by a predetermined threshold, wherein Z' is a gas deviation factor; $G_p$ is cumulative gas production, $G_t$ is total Original Gas in Place; P is average reservoir pressure; $P_i$ is initial reservoir pressure; ω is Fraction of Original Gas-In-Place (OGIP) initially stored in fractures; $\omega_a$ is Fraction of OGIP initially adsorbed in the organic matter; $\omega_d$ is Fraction of OGIP initially dissolved in the solid organic matter; $\omega_m$ is Fraction of OGIP initially stored in matrix; C' effective matrix compressibility; C" is effective fracture compressibility; ΔP is pressure drop in the reservoir given by $P_i$–P; $B_g$ gas formation volume factor; $\rho_b$ is shale bulk density; $V_L$ is Langmuir volume; $\phi_{mt}$ is total matrix porosity; $S_{wm}$ is average water saturation in matrix; $P_L$ is Langmuir pressure; $C_{(P)}$ is methane solubility (or concentration) in the solid organic matter; TOC is Total Organic Carbon; $\rho_r$ is relative density of the solid organic matter compared to the shale bulk density; $\phi_{ads_c}$ is adsorbed porosity scaled to the bulk volume of the composite system; $\phi_{org}$ is organic porosity scaled to the bulk volume of the composite system.

3. The method of claim 2, wherein the formation is a shale formation.

4. The method of claim 1 or 2, wherein the hydrocarbons include gaseous hydrocarbons.

5. The method of claim 2, further comprising monitoring the cumulative gas production, and wherein the predetermined wellbore characteristic is established at:

$$t_{refrac} = \frac{1}{C_{refrac}} \int_0^{G_{p_{refrac}}} \frac{dG_p}{\{[f(G_p)]^2 - P_{wf}^2\}^n}.$$

6. The method of claim 2, further comprising monitoring the temperature of the formation.

7. The method of claim 2, further comprising producing hydrocarbons from the second conditioned formation.

8. The method of claim 7, wherein the maximum volumetric rate of production of hydrocarbons from the second conditioned formation is at least 20% of the maximum volumetric rate of production of hydrocarbons from the first conditioned formation.

9. The method of claim 7 or 8, wherein the maximum volumetric rate of production of hydrocarbons from the second conditioned formation is at least 100% of the maximum volumetric rate of production of hydrocarbons from the first conditioned formation.

10. The method of claim 2, wherein the second hydraulic fracturing re-opens the fractures effected by the first hydraulic fracturing.

11. The method of claim 2, wherein the second hydraulic fracturing effects new fractures being formed in the second conditioned formation.

12. The method of claim 2, wherein the maximum pressure at which the treatment fluid is injected into the wellbore during the second hydraulic fracturing has a gradient of at least 0.65 psi per foot of depth.

13. The method of claim 2, wherein, during the second hydraulic fracturing, the treatment fluid is injected at an injection pressure of at least 0.65 psi per foot of depth into the wellbore during the second hydraulic fracturing for at least 0.1 days per fracturing stage.

14. The method of claim 2, wherein the hydrocarbons include liquid hydrocarbons.

15. The method of claim 14, wherein the hydrocarbons include at least 10%, by volume, of the liquid hydrocarbons.

16. The method of claim 14, wherein the hydrocarbons include at least 25%, by volume, of the liquid hydrocarbons.

17. The method of claim 14, wherein the hydrocarbons include at least 50%, by volume, of the liquid hydrocarbons.

18. The method of claim 17, wherein the hydrocarbons include at least 91%, by volume, of the gaseous hydrocarbons.

19. A method for capturing hydrocarbons from a formation comprising:

after a first hydraulic fracturing of a formation to produce a first conditioned formation, and after hydrocarbons have been produced from the first conditioned formation, and after a formation pressure of the formation has become disposed below a predetermined pressure, effecting a second hydraulic fracturing of the formation to produce a second conditioned formation, wherein the predetermined wellbore characteristic is established when $$\frac{\partial \frac{P}{Z}}{\partial G'_p} = 0,$$

wherein:

$$\frac{G_p}{G_t} = 1 - \frac{P/Z'}{P_i/Z_i} \text{ and}$$

$$Z' = Z\left[1 - \omega_a - \omega_d - (\omega_m C' + \omega C'')\Delta P + \left(\frac{\omega_m B_g \rho_b V_L}{35.315\phi_{mt}(1 - S_{wm})}\frac{P}{P_L + P}\right) + \left(\frac{1.057\omega_m C_{(P)} B_g}{\phi_{mt}(1 - S_{wm})}\right)\left(\frac{TOC}{100\rho_r} - \phi_{ads_c} - \phi_{org}\right)\right]^{-1},$$

wherein Z' is a gas deviation factor; $G_p$ is cumulative gas production, $G_t$ is total Original Gas in Place; P is average reservoir pressure; $P_i$ is initial reservoir pressure; ω is Fraction of Original Gas-In-Place (OGIP) initially stored in fractures; $\omega_a$ is Fraction of OGIP initially adsorbed in the organic matter; $\omega_d$ is Fraction of OGIP initially dissolved in the solid organic matter; $\omega_m$ is Fraction of OGIP initially stored in matrix; C' effective matrix compressibility; C" is effective fracture compressibility; ΔP is pressure drop in the reservoir given by $P_i$–P; $B_g$ gas formation volume factor; $\rho_b$ is shale bulk density; $V_L$ is Langmuir volume; $\phi_{mt}$ is total matrix porosity; $S_{wm}$ is average water saturation in matrix; $P_L$ is Langmuir pressure; $C_{(P)}$ is methane solubility (or concentration) in the solid organic matter; TOC is Total Organic Carbon; $\rho_r$ is relative density of the solid organic matter compared to the shale bulk density; $\phi_{ads_c}$ is adsorbed porosity scaled to the bulk volume of the composite system; $\phi_{org}$ is organic porosity scaled to the bulk volume of the composite system.

20. A method for capturing hydrocarbons from a formation comprising:

after a first hydraulic fracturing of a formation to produce a first conditioned formation, and after hydrocarbons have been produced from the first conditioned formation, and after a formation pressure of the formation has become disposed below a predetermined pressure, effecting a second hydraulic fracturing of the formation to produce a second conditioned formation, wherein the predetermined wellbore characteristic is established when the difference between:

a)

$$\frac{\partial \frac{P}{Z}}{\partial G'_p} \text{ where:}$$

$$\frac{G_p}{G_t} = 1 - \frac{P/Z'}{P_i/Z_i} \text{ and}$$

$$Z' = Z\left[1 - \omega_a - \omega_d - (\omega_m C' + \omega C'')\Delta P + \left(\frac{\omega_m B_g \rho_b V_L}{35.315\phi_{mt}(1 - S_{wm})}\frac{P}{P_L + P}\right) + \left(\frac{1.057\omega_m C_{(P)} B_g}{\phi_{mt}(1 - S_{wm})}\right)\left(\frac{TOC}{100\rho_r} - \phi_{ads_c} - \phi_{org}\right)\right]^{-1}; \text{ and}$$

b)

$$\frac{\partial \frac{P}{Z}}{\partial G'_p} \text{ where:}$$

$$\frac{G_p}{G_t} = 1 - \left(\frac{P/Z}{P_i/Z_i}\right)\{1 - [(1 - \omega)C' + \omega C'']\Delta P\}$$

differ by a predetermined threshold, wherein Z' is a gas deviation factor; $G_p$ is cumulative gas production, $G_t$ is total Original Gas in Place; P is average reservoir pressure; $P_i$ is initial reservoir pressure; ω is Fraction of Original Gas-In-Place (OGIP) initially stored in fractures; $\omega_a$ is Fraction of OGIP initially adsorbed in the organic matter; $\omega_d$ is Fraction of OGIP initially dissolved in the solid organic matter; $\omega_m$ is Fraction of OGIP initially stored in matrix; C' effective matrix compressibility; C" is effective fracture compressibility; ΔP is pressure drop in the reservoir given by $P_i$–P; $B_g$ gas formation volume factor; $\rho_b$ is shale bulk density; $V_L$ is Langmuir volume; $\phi_{mt}$ is total matrix porosity; $S_{wm}$ is average water saturation in matrix; $P_L$ is Langmuir pressure; $C_{(P)}$ is methane solubility (or concentration) in the solid organic matter; TOC is Total Organic Carbon; $\rho_r$ is relative density of the solid organic matter compared to the shale bulk density; $\phi_{ads_c}$ is adsorbed porosity scaled to the bulk volume of the composite system; $\phi_{org}$ is organic porosity scaled to the bulk volume of the composite system.

21. The method of claim 20, wherein the formation is a shale formation.

22. The method of claim 20, wherein the hydrocarbons are gaseous hydrocarbons.

23. The method of claim 20, further comprising producing hydrocarbons from the second conditioned formation.

24. The method of claim 23, wherein the maximum volumetric rate of production of hydrocarbons from the second conditioned formation is at least 20% of the maximum volumetric rate of production of hydrocarbons from the first conditioned formation.

25. The method of claim 23, wherein the maximum volumetric rate of production of hydrocarbons from the second conditioned formation is at least 100% of the maximum volumetric rate of production of hydrocarbons from the first conditioned formation.

26. The method of claim 20, wherein the second hydraulic fracturing re-opens the fractures effected by the first hydraulic fracturing.

27. The method of claim 20, wherein the second hydraulic fracturing effects new fractures being formed in the second conditioned formation.

28. The method of claim 20, wherein the maximum pressure at which the treatment fluid is injected into the wellbore during the second hydraulic fracturing has a gradient of at least 0.65 psi per foot of depth.

29. The method of claim 20, wherein, during the second hydraulic fracturing, the treatment fluid is injected at an injection pressure of at least 0.65 psi per foot of depth into the wellbore during the second hydraulic fracturing for at least 0.1 days per fracturing stage.

* * * * *